US005306329A

United States Patent [19]

Goodman, Jr.

[11] Patent Number: 5,306,329

[45] Date of Patent: Apr. 26, 1994

[54] PHOSPHOROUS DEOXIDATION OF METAL

[76] Inventor: Warren B. Goodman, Jr., 306 Pine Tree Rd., Radnor, Pa. 19087

[21] Appl. No.: 45,409

[22] Filed: Apr. 9, 1993

[51] Int. Cl.[5] ..... C22B 9/02

[52] U.S. Cl. ..... 75/646; 420/33

[58] Field of Search ..... 75/652; 420/33

[56] References Cited

U.S. PATENT DOCUMENTS

| | | | |
|---|---|---|---|
| 2,098,063 | 11/1937 | Perrin | 75/76 |
| 2,164,228 | 6/1939 | Burns | 75/652 |
| 3,528,803 | 9/1970 | Ichikawa et al. | 75/652 |
| 3,844,772 | 10/1974 | Sherman | 75/76 |

FOREIGN PATENT DOCUMENTS

| | | | |
|---|---|---|---|
| 1552153 | 9/1979 | United Kingdom | 75/652 |

OTHER PUBLICATIONS

Robert A. Colton, "How To Deoxidize With Phosphor Copper", *Foundry*, Jul. 1956, reprinted in a brochure from Federated Metals, Division of American Smelting and Refining Company, 120 Broadway, New York 5, N.Y.

Reference AQ, *Kirk-Othmer Encyclopedia of Chemical Technology* Second Edition, "Phosphorus and the Phosphides", (John C. Wiley & Sons, Inc.) vol. 15, pp. 292-294, 1968.

*Primary Examiner*—Peter D. Rosenberg

*Attorney, Agent, or Firm*—Seidel, Gonda, Lavorgna & Monaco

[57] ABSTRACT

Molten metal is deoxidized by continuous or semi-continuous treatment with liquid elemental phosphorous in a sufficient amount to produce a deoxidized metal with a final phosphorous content not greater than about 1% by weight.

11 Claims, 1 Drawing Sheet

PHOSPHOROUS DEOXIDATION OF METAL

FIELD OF THE INVENTION

The invention relates to a process for deoxidizing metal and metal alloys by continuously or semi-continuously treating the same with liquid elemental phosphorous. This process provides an alternative to existing deoxidizing processes which utilize phosphor copper alloy as the deoxidizing agent.

BACKGROUND OF THE INVENTION

Phosphor copper alloys are utilized in the metal and metal melting industry to remove oxygen trapped in the molten metal, to increase the fluidity of the molten metal, and remove unwanted impurities in the molten metal. Phosphorous is a good deoxidizer due to its strong affinity for oxygen. Phosphor copper has been used for deoxidizing metals in the past on the belief that the master alloy is easier and safer to handle than elemental phosphorous.

The most common type of phosphor copper alloy contains approximately 15% phosphorous and 85% copper.

U.S. Pat. No. 2,164,228 (Burns) discloses a batch-wise method of adding liquid phosphorous, which is immersed in a body of water, to a crucible or pot of molten metal to produce phosphorous alloys. There is no mention of adding the liquid phosphorous at any particular rate or treating the molten metal for excess oxygen.

U.S. Pat. No. 3,844,772 (Sherman) discloses injecting liquid methanol into molten copper. There is no mention of adding liquid phosphorous to the molten copper, nor is there any mention of the rate at which the liquid methanol is added to the molten copper.

U.S. Pat. No. 3,528,803 (Ichikawa et al.) discloses the addition of ingot, plate, rod, chip, grain, or powder forms of phosphorous or phosphorous alloys in molten copper to remove hydrogen. This is no mention of the addition of liquid elemental phosphorous to molten copper.

U.S. Pat. No. 2,098,063 (Perrin) discloses adding liquid metaphosphoric acid into a pouring jet of copper.

British Patent No. 1,552,153 (Elton) discloses removing copper from lead and lead alloys by adding phosphorous to the melt at intervals. The intervals between additions are such that the reaction caused by the previous addition has been completed prior to the next addition of phosphorous. However, the phosphorous is not in liquid form.

SUMMARY OF THE INVENTION

The invention provides a process for deoxidizing metal by continuously or semi-continuously treating a stream or bath of molten metal with deoxidizing agent consisting essentially of liquid elemental phosphorous in an amount sufficient to deoxidize the metal to produce a deoxidized metal with a final phosphorous content not greater than 1% by weight. More particularly, a sufficient amount of liquid elemental phosphorous, contacts a stream or bath of molten metal to produce a deoxidized metal with a final phosphorous content not greater than about 1% by weight. As used in the herein specification and appended claims, "metal" is defined to mean any elemental metal, metal compound or metal alloy. Elemental phosphorous is defined to mean substantially pure phosphorous as generally provided in the industry.

DETAILED DESCRIPTION OF THE INVENTION

Figure 1:
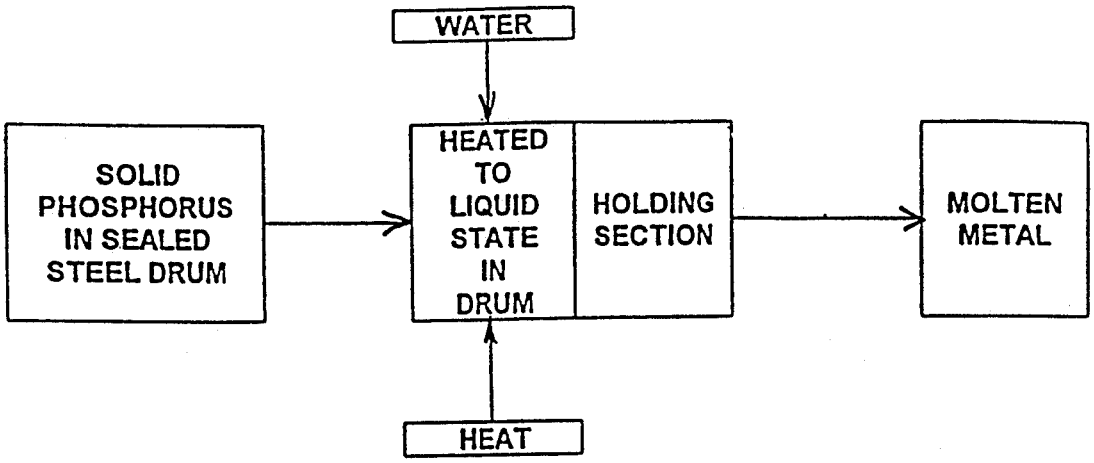
FIG. 1 is a schematic diagram of the deoxidation of metal with phosphorous process of the present invention.

It has been found that a deoxidizing agent, consisting essentially of liquid elemental phosphorous, can be substituted for 15% phosphor copper alloy in the deoxidation of metals. Elemental liquid phosphorous can be introduced into a stream or bath of molten metal to be deoxidized at a rate significantly lower than when phosphor copper alloy is utilized as the deoxidizing agent. Numerous advantages can be gained by practicing this invention. For instance, the amount of smoke generated during the deoxidation process utilizing liquid elemental phosphorous as a deoxidizer is minimal to non-existent. Significant cost savings from raw materials are achieved. Additionally, quality control is improved because the phosphorous and oxygen content is more consistent from run to run.

The most common phosphor copper alloy (85% copper; 15% phosphorous) is introduced into a stream or bath of molten metal to be deoxidized at a rate at least about 6 times greater than the rate of elemental phosphorous introduction according to the present invention. The invention thus provides for drastic reduction in the flow rate of deoxidant which is introduced into the stream or bath of molten copper to be deoxidized, without reducing the actual amount of phosphorous introduced. The amount of phosphorous introduced is controlled such that final phosphorous content of the deoxidized metal will not exceed about 1% by weight, more preferably not more than about 0.5%, most preferably not more than about 0.2%.

There are several ways that phosphorous may be introduced into a stream or bath of molten metal. One preferred technique is shown schematically in FIG. 1 and described in greater detail as follows. Generally, the process begins by immersing a container of solid elemental phosphorous in a tank of water. The water is heated to an elevated temperature in excess of the melting point of the elemental phosphorous, causing the phosphorous to liquify. The melting point is approximately 112 degrees Fahrenheit (44 degrees Celsius). The solid elemental phosphorous is completely melted to its liquid form. The liquid phosphorous is then removed from its container. The phosphorous remains immersed in water in the holding tank. It is then removed from the holding tank as needed for the deoxidation process. Under standard conditions, the major components of an apparatus for use in the deoxidation of metal by phosphorous operate under atmospheric pressure.

The phosphorous is kept in its liquid form by maintaining the water temperature in the holding tank in excess of the melting point of phosphorous. The water in the holding tank is maintained at a temperature in excess of about 112 degrees Fahrenheit (44 degrees Celsius). A preferred range of temperature under standard conditions is from about 120 degrees Fahrenheit (48 degrees Celsius) to about 185 degrees Fahrenheit (85 degrees Celsius). The most preferred temperature under standard conditions for the water is about 180 degrees Fahrenheit (82 degrees Celsius).

There are several ways that the liquid elemental phosphorous can be fed from the holding tank to the metal stream to-be-treated. As long as the holding tank is positioned close to and above the discharge point into the stream or bath of molten metal, gravity can be used to move the liquid elemental phosphorous. Otherwise, a pump, suitable for discharging phosphorous may be used. The phosphorous pump should be constructed from 316 stainless steel so that it can withstand the corrosive effects of liquid elemental phosphorous. The phosphorous pump is connected to a pump out-take and a conduit. The pump out-take is positioned within the holding tank and below the upper level of the liquid phosphorous in the tank. The conduit is positioned between the phosphorous pump and the stream or bath of molten metal to be deoxidized.

It is recommended that the conduit from the phosphorous pump to the stream or bath of molten metal comprise a jacketed pipe. The jacketed portion of the conduit should contain a fluid at an elevated temperature, to maintain the temperature of the elemental phosphorous above its melting point as it is pumped to the stream or bath of molten metal.

In casting operations where the molten metal flow rate is in the range of from about 5,000 lb/hr (2,250 kg/hr) to about 75,000 lb/hr (31,500 kg/hr), the flow rate of liquid phosphorous from the phosphorous pump to the stream or bath of molten metal will range from about 5 lb/hr (2 kg/hr) to about 200 lb/hr (90 kg/hr). The preferred flow rate is from about 15 lb/hr (6 kg/hr) to about 40 lb/hr (18 kg/hr). The liquid phosphorous is fed on a continual basis into the stream or bath of molten metal. Since the flow rate of the liquid phosphorous is significantly lower than in existing systems or processes, minimal amounts of $P_2O_5$ smoke are generated. By reducing the smoke emitted, the working environment is safer. As the liquid elemental phosphorous is discharged into the stream or bath of molten metal, sufficient agitation is created for thorough mixing and deoxidation.

The operator should take periodic samples to check the phosphorous and oxygen levels of the metal under treatment.

Elemental phosphorous can be difficult to handle because it ignites, burns and smokes when it comes in contact with oxygen. For this reason, phosphorous is provided in tank cars or in individual steel drums sealed from the atmosphere. The phosphorous typically is delivered in a solid state, air-tight and sealed with a water seal in the container. Similar special precautions should be taken in the practice of the present invention to ensure that the phosphorous is not exposed to oxygen prior to discharge into the stream or bath of molten metal.

During the phosphorous melting phase and prior to its discharge into the metal stream/bath, the phosphorous is submerged in an inert liquid, such as water. due to the high reactivity of phosphorous with air, a detection system (not shown) is recommended to monitor the level of the water in the tank and/or the separate section. The monitor will ensure that evaporation does not cause the water in the holding tank to fall below the upper level of the phosphorous.

Liquid phosphorous is denser than water. Therefore, the phosphorous sinks to the bottom of the holding tank and displaces the water as it becomes liquified. The out-take from the holding tank to the phosphorous pump should be positioned near the holding tank bottom. The upper level of the phosphorous layer must not drop below the level of the pump out-take, as that would permit water to enter the conduit and phosphorous pump. A hydrogen explosion can result if water comes in contact with the stream or bath of molten metal. Therefore, it is recommended that a monitor be provided for detecting the upper level of liquid elemental phosphorous or lower level of water in the tank.

The process described above for deoxidizing molten metals would be most beneficial for the following metals or metal alloys:

Copper, aluminum, tin, lead, zinc, nickel, silver, copper-aluminum alloys, copper-tin alloys, copper-lead alloys, copper-zinc alloys, copper-nickel alloys, copper-silver alloys, copper-tin-nickel alloys, copper-tin-silver alloys, copper-tin-lead alloys, copper-tin-zinc alloys, copper-lead-silver alloys, copper-lead-zinc alloys, copper-lead-nickel alloys, copper-zinc-nickel alloys, copper-zinc-silver alloys, copper-tin-lead-zinc alloys, copper-lead-zinc-nickel alloys, copper-lead-zinc-silver alloys, copper-zinc-nickel-silver alloys, copper-tin-lead-nickel alloys, copper-tin-lead-silver alloys, copper-tin-zinc-nickel alloys, copper-tin-zinc-silver alloys, copper-tin-nickel-silver alloys, copper-lead-nickel-silver alloys, copper-tin-lead-zinc-nickel-silver alloys, and combinations thereof.

Copper tubing mills, brass mills, copper ingot producers, brazing rod manufacturers and foundries will benefit from this process.

The following example will illustrate the present invention, wherein copper metal is cast at a rate of 35,000 lb of copper/hr (15,750 kg of copper/hr). The apparatus for deoxidizing the copper comprises a heater, a tank for immersing and melting the elemental phosphorous, a pump and transfer line for transferring the liquid elemental phosphorous from the tank to the stream or bath of molten copper. The tank is designed to be large enough to maintain at least one container of phosphorous submerged beneath water. The heater is designed to increase the temperature of the water in the tank in excess of 180 degrees Fahrenheit.

The process of the present invention begins by liquefying the solid elemental phosphorous while in its container. The container of solid elemental phosphorous is placed in a tank of water heated to a temperature of about 180 degrees Fahrenheit (83 degrees Fahrenheit). Once the contents of the container have been melted, the liquid elemental phosphorous is then removed from its container and placed in a separate section of the tank. The liquid elemental phosphorous is not exposed to oxygen during the transfer from its original container to the separate section of the tank.

The liquid elemental phosphorous is removed from the separate section of the tank as needed for deoxidation. The liquid elemental phosphorous is removed by a pump and travels along a conduit to the stream of molten metal. The liquid elemental phosphorous is discharged directly into the stream or bath of molten metal through a graphite tube extending into the stream or bath of molten metal.

In some copper casting applications, it has been discovered that approximately 50% of the phosphorous added to the molten metal for deoxidation will react with oxygen while the remaining 50% of phosphorous will be left in the finished product. The percentage of phosphorous that reacts with oxygen varies for each casting application. Where, for example, the final copper product must contain no more than about 0.04% phosphorous, and half of the added phosphorous will react with oxygen, then approximately 28 lbs of phosphorous/hr (13 kg of phosphorous/hr) is discharged continuously or semi-continuously into the stream or bath of molten metal at a flow rate of 35,000 lb/hr (15,750 kg/hr). The actual flow rate of phosphorous in other casting applications is dependent on the final specification requirements for phosphorous and the percentage of phosphorous that reacts with oxygen.

The present embodiment may be embodied in other specific forms without departing from the spirit or essential attributes thereof and, accordingly, reference should be made to the appended claims, rather than to the foregoing specification, as indicating the scope of the invention.

I claim:

1. A process for deoxidizing metal, which comprises continuously or semi-continuously treating a stream or bath of molten metal, selected from the group consisting of copper and brass, with a deoxidizing agent consisting essentially of liquid elemental phosphorous in an amount sufficient to deoxidize the metal but not more than 1% by weight based upon the weight of said molten metal, whereby the deoxidized metal so produced has a phosphorous content not greater than 1% by weight.

2. The process according to claim 1, wherein the phosphorous content of the deoxidized metal does not exceed about 0.5% by weight.

3. The process according to claim 2, wherein the liquid elemental phosphorous is generated by melting solid elemental phosphorous in water.

4. The process according to claim 3, wherein the temperature of the water is maintained in the range from about 120 degrees Fahrenheit to about 185 degrees Fahrenheit.

5. The process according to claim 4, wherein the temperature of the water is maintained at about 180 degrees Fahrenheit.

6. The process according to claim 2, wherein the liquid elemental phosphorous contacts a stream of molten metal flowing in the range of from 5,000 lb to about 75,000 lb per hour of metal, and the flow rate of the phosphorous stream contacting the molten metal is from about 5 pounds to about 200 pounds of phosphorous per hour.

7. The process according to claim 6, wherein the liquid elemental phosphorous contacts the stream of molten metal at a rate from about 15 pounds to about 40 pounds of phosphorous per hour.

8. The process according to claim 6, wherein prior to contacting the stream of molten metal, the liquid elemental phosphorous is maintained at a temperature in excess of about the melting point of phosphorous.

9. The process according to claim 8, wherein prior to contacting the stream of molten metal, the liquid elemental phosphorous is maintained at a temperature in the range from about 120 degrees Fahrenheit to about 185 degrees Fahrenheit.

10. The process according to claim 9, wherein prior to contacting the stream of molten metal, the liquid elemental phosphorous is maintained at a temperature at about 180 degrees Fahrenheit.

11. The process according to claim 1, wherein the phosphorous content of the deoxidized metal does not exceed about 0.04% by weight.

* * * * *